US005211172A

United States Patent [19]

McGuane et al.

[11] Patent Number: 5,211,172

[45] Date of Patent: May 18, 1993

[54] SOLAR CONTROLLED SUN TRACKER FOR A SUNBATHER

[76] Inventors: Joseph B. McGuane, 41 Holden Rd.; Martin J. Lawless, 58 Holden Rd., both of Shirley, Mass. 01464; Fei-Jain Wu, 15 Warwick Dr., Chelmsford, Mass. 01824

[21] Appl. No.: 677,235

[22] Filed: Mar. 29, 1991

[51] Int. Cl.[5] ..... A61H 33/06

[52] U.S. Cl. ..... 128/377; 128/376; 128/362; 297/217

[58] Field of Search ..... 128/372, 378, 377, 376, 128/362; 297/217

[56] References Cited

U.S. PATENT DOCUMENTS

| | | | |
|---|---|---|---|
| 3,908,666 | 9/1975 | Osborne | 128/372 |
| 4,279,254 | 7/1981 | Boschetti et al. | 128/395 |
| 4,379,588 | 4/1983 | Speice | 128/372 |
| 4,441,220 | 4/1984 | Peterson | 128/376 |
| 4,579,119 | 7/1986 | Padgett | 128/372 |
| 4,720,140 | 1/1988 | Change, III | 297/217 |
| 4,856,520 | 8/1989 | Bilicki | 128/372 |
| 4,933,618 | 6/1990 | Ortlieb | 128/372 |
| 4,989,600 | 2/1991 | Collier | 128/372 |

*Primary Examiner*—Jessica J. Harrison

*Attorney, Agent, or Firm*—Pandiscio & Pandiscio

[57] ABSTRACT

Apparatus for rotating a sunbather's lounge chair in the sun so that the sunbather lying on the chair is exposed to the sun even while the sun direction changes from sunrise to sunset includes a sun direction detector for detecting the relative direction of the sun direct rays to the chair and produces electrical signals representative of that relative direction, the chair being carried on a rotatable platform driven clockwise (CW) or counterclockwise (CCW) as requires to position the lounge chair in the direct rays of the sun; the sun direction detector including two directional photo-detectors on the rotatable platform, held with their directions normal to generally upright planes that meet at an angle less than 180°, and the drive driving the platform to maintain the outputs of the photo-detectors equal or in a predetermined relationship.

9 Claims, 4 Drawing Sheets

SOLAR CONTROLLED SUN TRACKER FOR A SUNBATHER

BACKGROUND OF THE INVENTION

This invention relates to lounge and beach chairs on which a person reclines to sunbathe.

Getting a suntan is an effort engaged in by people living (or vacationing) at all latitudes. It only requires a bright sun, some shelter from any wind and a warm ambient temperature; and if the ambient temperature is not warm, the sunbather may be protected by a transparent shelter. Many sunbathers prefer to lie on a lounge chair, which may be portable, fixed and/or may fold-up. The usual place for sunbathing is at an ocean or lake beach or alongside a swimming pool. Such lounge chairs are often provided by the proprietor of the beach or pool, or are brought to the scene by the sunbather.

In just about all cases, the sunbather wants an even tan and to avoid getting a sunburn. Getting an even tan requires that the sunbather lie with exposed parts of the body in the direct rays of the sun, and that requires that the sunbather move frequently to follow the sun. To avoid sunburn the sunbather limits the time of exposure to the sun, applies a sun screen to the exposed parts of the body and repositions the body frequently to expose the body evenly without overexposing any parts of the body. All sunbathers are advised to limit the time of exposure and to apply a sun screen.

After applying a sun screen, the sunbather must do all of the following:

(a) lie with exposed parts of the body in the direct rays of the sun and move frequently to follow the sun;

(b) when in the direct rays of the sun, roll the body to particularly expose the Front left (FL) side, the Front center (FC) and the Front right (FR) side, then the Back left (BL) side, the Back center (BC) and the Back right (BR) side;

(c) measure exposure time of the Front and Back L, C and R sides and move those sides out of the sun to avoid exceeding exposure time; and (d) turn the body away from the sun and/or into shade when necessary to avoid exposure.

Even with the best intentions, all of these efforts are defeated when the sunbather falls asleep or is distracted from the efforts.

It is an object of the present invention to provide apparatus that aids the sunbather to properly and safely perform at least some of the above mentioned steps that insure getting an even tan and to avoid overexposure and sunburn.

It is another object of the present invention to provide such apparatus that responds to movement of the sun.

It is another object of the present invention to provide such apparatus that operates automatically.

It is another object of the present invention to provide such apparatus that operates automatically and derives power for said operation from solar energy.

It is another object of the present invention to provide such apparatus that operates automatically and includes a conventional lounge chair and means adapted therefore for performing said automatic operation.

It is another object of the present invention to provide such apparatus that responds to preset requirements of the sunbather.

It is another object of the present invention to provide such apparatus that responds to preset programs designed for the sunbather's safety.

It is another object of the present invention to provide such apparatus that tracks the sun and provides sun detectors, apparatus drives and drive power and control on the driven part of the apparatus.

BRIEF DESCRIPTION OF THE INVENTION

Apparatus for rotating a sunbather's lounge chair in the sun so that the sunbather lying on the chair is exposed to the sun includes a sun direction detector for detecting the relative direction direct rays of the sun to the chair and producing electrical signals representative of that relative direction. The chair is carried on a rotatable platform and a drive motor drives that platform in rotation with respect to ground so that the sunbather is exposed to direct rays of the sun even while the sun direction changes between sunrise and sunset.

According to a first embodiment, the sun direction detector includes two directional photo-detectors, the clockwise photo-detector, CW, and the counterclockwise photo-detector, CCW, carried on the rotatable platform, each held with its direction normal to a different generally upright plane and those planes define an included angle between 0° and 180°, so that changes in the difference between the output signals from the CW and CCW photo-detectors are representative of changes in the direction of the sun with respect to the chair.

DESCRIPTION OF EMBODIMENTS OF THE INVENTION

Figure 1:
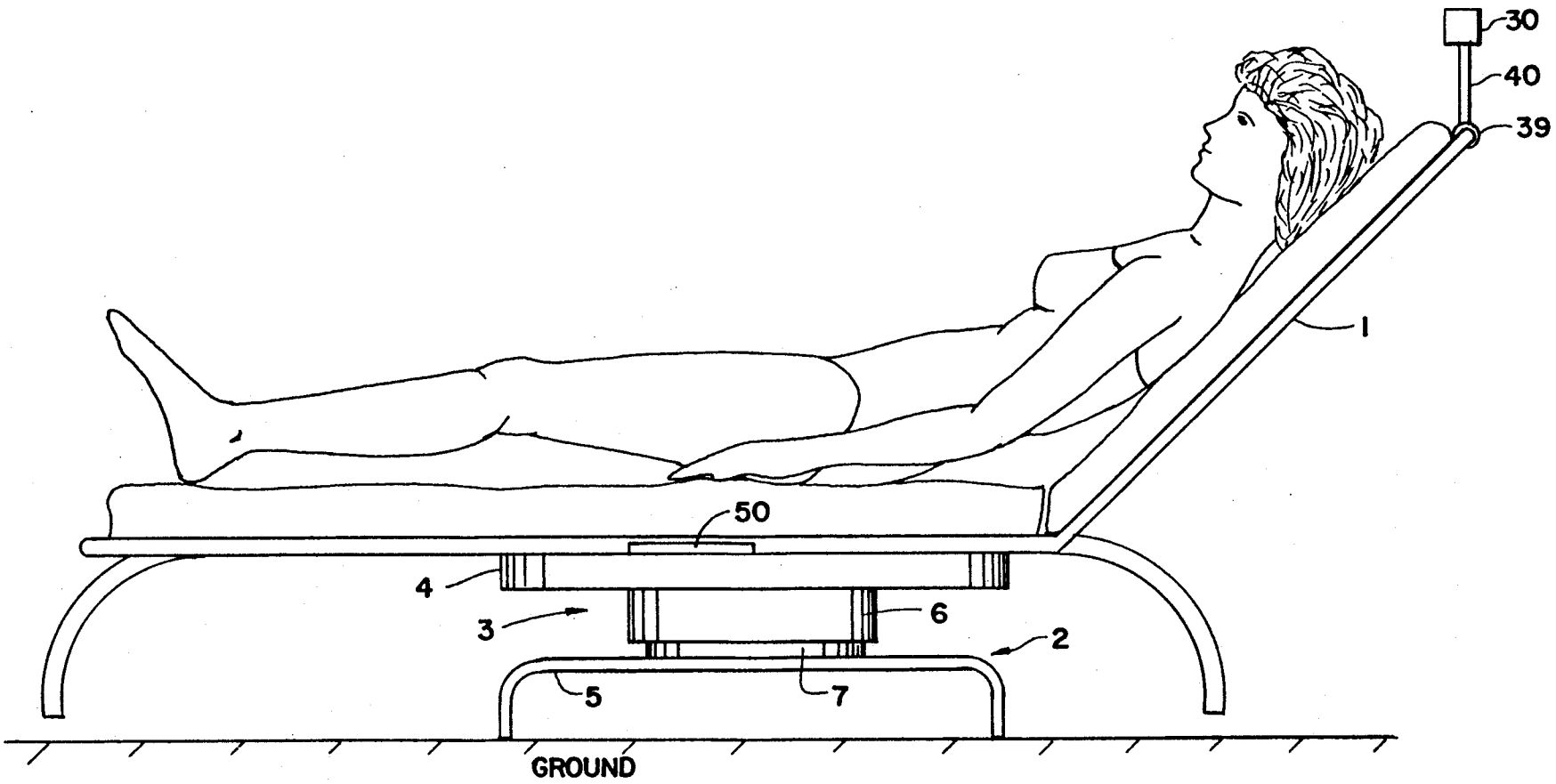
FIG. 1 is a side elevation view of a first embodiment of apparatus according to the present invention including a lounge chair for the sunbather on a rotated platform, wherein all sun detectors, drives, drive power and drive controls are carried on the rotated platform.

FIG. 1 is a side elevation view of apparatus according to the present invention. In this embodiment the sunbather's lounge chair 1 is rotated by a null type feedback drive system in the apparatus 2 that follows (tracks) the sun; and the sun direction detector, the motor drive, drive power source and motor control circuits are all carried on the rotated part of the apparatus.

As shown in FIG. 1, a conventional lounge chair 1 is completely supported on the apparatus 2 that contains rotation drive mechanism 3 according to the present invention. Fastened to the top of drive mechanism 3 is a broad chair support 4 for the chair so that the sunbather can move relatively freely on the chair without tipping the chair off of the support. Furthermore, the height of the chair from the ground is only a few inches greater than when the chair is directly on the ground without the support.

Figure 2:
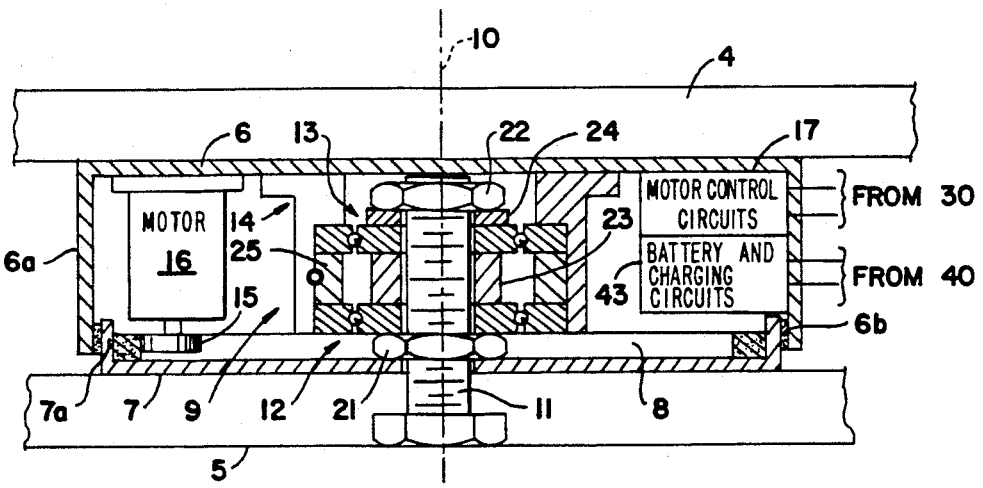
FIG. 2 is an enlarged cross section side elevation view of the first embodiment showing mechanical parts of the apparatus and the drive, drive power and drive controls carried on the rotated platform.

Chair support 4 and the drive mechanism 3 includes a ground base 5 and a rotated platform 6, as shown in FIG. 2, which is an enlarged cross section side elevation view of the mechanism. Ground base 5 includes a base plate 7 containing a circular drive track 8 which is concentric with the axis of rotation 10 of the apparatus and attached to the base plate on the inside of peripheral flange 7*a* thereof. Rotated platform 6 has a cylindrical skirt 6*a* that extends downward enclosing the peripheral flange 7*a* of the base plate. A low friction sliding seal 6*b* is provided between the skirt and flange to prevent dirt and water from entering the enclosed space 18 inside drive mechanism 3. Within drive mechanism 3, in space 18 between base plate 7 and rotated platform 6 is the axle and bearing assembly 9 including axle 11 that is bolted securely to ground base 5 and tandem, double sealed ball bearings 12 and 13 along the axle.

Figure 3:
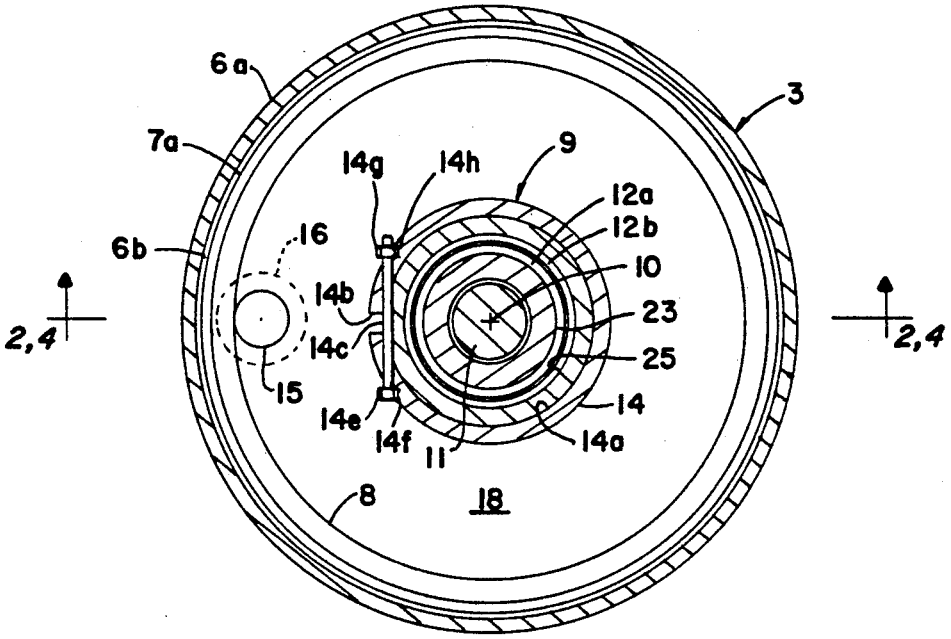
FIG. 3 is a top enlarged cross section view of the axle and bearings that support the rotated platform of the apparatus from the ground base.

The inner races of tandem bearings 12 and 13 are secured to the axle and the outer races are secured to rotated platform 6 by split sleeve bearing support 14 that is securely attached to the inside bottom of platform 6. Bearings 12 and 13 are each rated at about three hundred pounds thrust force and five hundred pounds radial force. They are spaced apart axially along the axle with sufficient spacing that the drive mechanism functions without damage even when a heavy sunbather moves and gets off and on the chair. Base plate 7, rotated platform 6 and the axle and bearing assembly 9 are also shown in FIG. 3, which is a top cross section view of mechanism 3, taken as shown in FIG. 2. An enlarged view of axle and bearing assembly 9, of the same perspective as FIG. 2, is shown in FIG. 4.

Rotated platform 6 is driven in rotation about the vertical axis 10 by motor drive wheel 15 of electric drive motor 16 that is mounted to the bottom of rotated platform 6. Depending on the electric power signal to the motor from motor control circuits 17, the motor drives platform 6 clockwise (CW) or counterclockwise (CCW) about axis 10. The motor drive wheel 15, driving against track 8 on the inside of the ground base flange 7*a* and the axle and bearing assembly are all shown in FIG. 3 which is a top view of the mechanism.

AXLE AND BEARING ASSEMBLY

Figure 4:
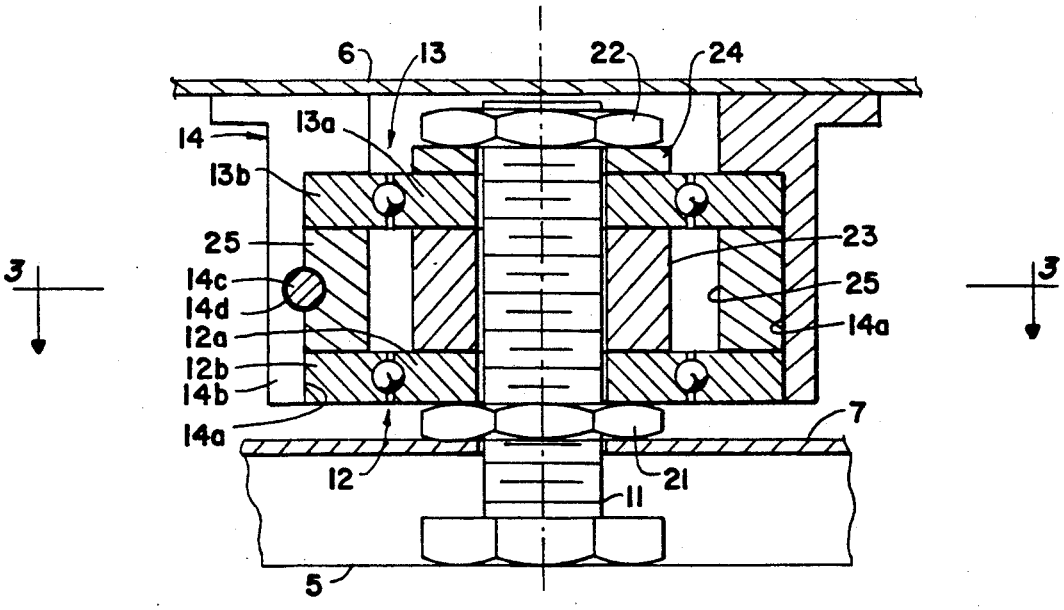
FIG. 4 is an enlarged cross section side elevation view of the mechanical parts of the apparatus showing details of the rotation axle and bearings, taken as shown in FIG. 3.

Axle and bearing assembly 9, shown enlarged in FIG. 4, includes axle bolt 11 that defines the axis of rotation 10. The bolt extends upright from ground base 5, through a sealed opening in base plate 7 into the enclosed space 18 between the base plate and rotated 6 and the platform skirt 6*a*. Space 18 is partially sealed by low friction seal 6*b* between skirt 6*a* and the periphery 7*a* of the base plate.

The axle bolt carries ball bearings 12 and 13. The inner races of these ball bearings are fixedly attached to the bolt between nut 21 that secures the bolt to the ground base and lock nut 22 at the top end of the bolt. The inner races 12*a* and 13*a* are clamped between nuts 21 and 22 and positioned axially along the bolt by spacing cylinders 23 and 24.

The outer races 12*b* and 13*b* are held by split sleeve 14 that is securely attached to rotated platform 6 at the top of space 18. For that purpose, an annular recess 14*a* is provided on the inside of sleeve 14 into which the outer races 12*b* and 13*b* fit and are spaced apart by spacing cylinder 25. Across the split 14*b* of sleeve 14 is sleeve tightening bolt 14*c* through clearance hole 14*d*. The head 14*e* of bolt 14*c* sits in notch 14*f* in the sleeve and the bolt nut 14*g* sits in notch 14*h* in the sleeve. When this bolt is tightened, the split sleeve grips and holds securely the outer races of the bearings and spacing cylinder 25.

Figure 5:
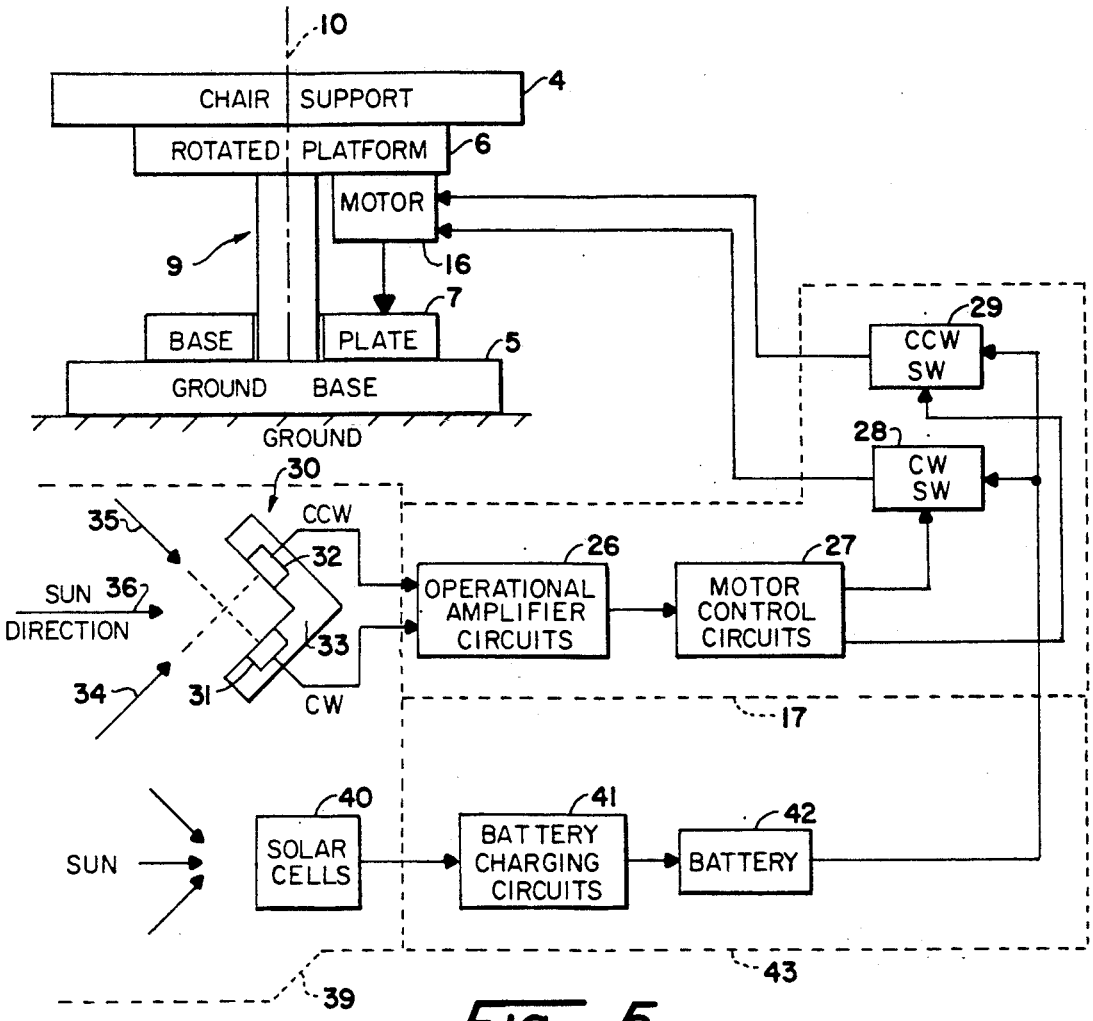
FIG. 5 is a schematic electrical-mechanical diagram of the apparatus of the first embodiment including a first novel sun direction detector, a solar powered battery source and null drive mechanism, all carried on the rotated platform, for rotating the chair to follow the sun.

Operation of the apparatus to rotate the lounge chair (with sunbather) to track the sun is accomplished using the motor control circuits 17, shown in FIG. 5, which is a schematic electrical-mechanical diagram of the apparatus, and the sun direction detector 30, solar powered battery source 40 and drive mechanism 3 for rotating the chair.

PAIR OF ANGLED SUN DIRECTION DETECTORS

Sun direction detector 30 includes two photo-detectors, photo-detector CW 31 and photo-detector CCW 32, both held by right angle holder 33 so that their maximum exposure directions are at a right angle to each other in vertical planes. With this arrangement, presuming that the sun direction lies in the quadrant defined by the right angle holder: when one photo-detector produces a maximum output signal, the other produces a minimum output signal; and when the sun direction splits the right angle, they produce equal output signals. Thus, when sun direction detector 30 is attached to the lounge chair, the signals CW and CCW from photo-detectors 31 and 32, respectively, carry enough information to determine the relative azimuth direction from the lounge chair to the sun over at least that quadrant (90° angle).

ANALOG OPERATION

In this first embodiment, sun direction detector 30 is attached to the rotated part of the apparatus or the chair on the rotated platform, which rotates with the platform. When detector 30 photo-detectors are exposed to the direct rays of the sun, such as represented by arrows 34 or 35, the CCW and CW signals will not be balanced, and this will cause mechanism 3 to rotate platform 6 (and the detector 30 carried thereby) to bring them into balance. For example, when the sun is from the direction of arrows 34 CCW is not equal to CW and the platform will rotate counterclockwise until the relative sun direction is within the direction of arrow 36 so that CCW=CW. In this way the first embodiment performs as a null type feedback system that rotates the chair to track the sun.

The right angle (90°) orientation of the CW and CCW photo-detectors 31 and 32 can be more or less than 90°. That angle can't be zero, and it can't be 180°. The preferred angle is 90°.

In the operation carried out by the system shown in FIG. 5, the signals CW and CCW from the photo-detectors 31 and 32 are fed to operational amplifier circuit 26, which compares the two signals and calls for energizing motor 16 to drive the chair CW or CCW so that it faces directly into the sun (the sunbather faces directly into the sun).

Motor control circuits 27 produce CW and CCW signals that control motor power switches 28 and 29. CW switch 28 feeds power from battery 42 to drive motor 16 causing the motor to drive platform 6 in the CW direction. CCW switch feeds battery power to another input of motor 16 causing the motor to drive the platform in the CCW direction. Drive continues until the signals CW and CCW from the photo-detectors are equal, presuming that the photo-detectors are balanced, and the drive stops. Thus, the drive occurs until the differential between CW and CCW from the balanced photo-detectors is zero (a null).

Additional analog controls can be provided to the system shown in FIG. 5 to bias the control signals CW and CCW from the photo-detectors. For example, the sunbather may wish to track the sun so that it is always to the sunbather's left (L), or it is always to the sunbather's right (R), rather than center (C) (straight ahead), Sun direction detector 30 must be mounted so as to rotate with platform 6 and, preferably, where it will not likely be overcast by a shadow. A convenient place for this is at the highest point of the chair as shown in FIG. 1 where detector 30 is held by support 39. Solar cells 40 need not rotate with the platform, but also should not be located where they will likely be overcast by a shadow. Furthermore, the solar cells will be most productive if they are always directed toward the sun. Thus, the preferred location for the solar cells is at support 39.

For this embodiment motor 16, motor control circuits 17, battery and charging circuits 43, sun direction sensor 30 and solar cells 40 are all carried on rotated platform 6. With this arrangement, no electrical connections have to be made across parts that rotate with respect to each other. For the sunbather's convenience, a control pad 50 can be located on chair support 4 alongside the chair.

ADDITIONAL FEATURES—COMPUTER SUPPLEMENT

Figure 6:
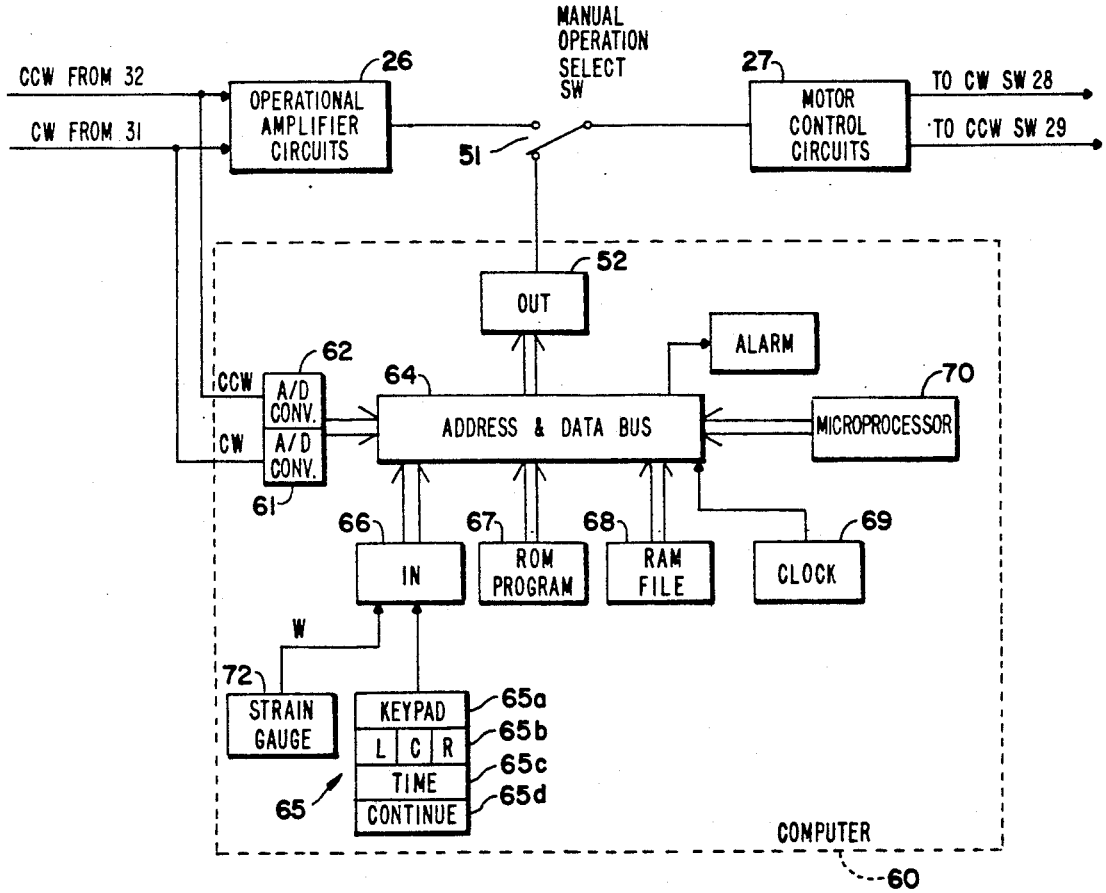
FIG. 6 is a schematic electrical diagram of additional computer apparatus for the first embodiment that increases features of the apparatus to accommodate in situs programming by the user, pre-programs and analysis of the sun direction detector signals (from right angle photo-detectors) to position the sunbather to expose FL, FC, FR, BL, BC and BR sides of the body and to position the sunbather out of the sun (in shade).

FIG. 6 is a schematic electrical diagram of additional computer system 60 (the computer) that increases performance features of the apparatus shown in FIG. 5 to accommodate in situs programming by the sunbather, pre-programs and analysis of sun direction detector 30 signals CW and CCW to position the sunbather to expose the Front (F) and the Back (B) left (L), center (C) and right (R) sides of the body and to position the sunbather out of the sun (in shade). Here, the analog signals CW and CCW from photo-detectors 31 and 32 are also fed to the computer and to manually operated select switch 51 for the sunbather on control pad 50 to select the output that controls the motor: the operational amplifier circuit 26 or the output of computer 60. The computer output is converted to analog by output digital to analog (D/A) converter 52 and the output of that converter is fed to a terminal of switch 51.

The inputs to computer system 60, to the computer address and data bus 64 inlude: CW and CCW converted to digital values by A/D converters 61 and 62; keypad 65 inputs by the sunbather to select maximum exposure time for the sunbather's Front (F) and Back (B) with the sun from the sunbather's left, center and right (L, C and R); a fixed read only memory (ROM) program from ROM circuit 67 that provides fixed values for computing relative direction (azimuth) from the chair to the sun, random access memory (RAM) file from RAM circuits 68, which stores override signals that limit exposure in case the sunbather selects excessive exposure times and stores the response characteristics of the photo-detectors; a clock 69; and a microprocessor 70 that controls operation of the computer system.

In operation, the motor rotates the chair until CW=CCW just as described above for analog operation. This places the chair at the same azimuth direction as the sun. If the sunbather has called for exposure in a particular sequence: for example first the Front center (FC), then the Front left (FL) and then the Front right (FR) and the exposure time for each of these sequences, the computer imposes a position bias to position the sunbather for left (L) and right (R) and also computes for each position the exposure time incurred by the other sides of the body. After the FC exposure, the FL exposure time selected by the sunbather is modified in view of the partial exposure of the FL side during the FC exposure, and so forth.

Personal input commands of the sunbather are input to the computer system using keypad 65, via input circuit 66. The sunbather keys in desired Front C, L and R exposure times and also Back C, L and R exposure times at the start of sunbathing and the computer determines relative positioning of the sunbather's body with respect to the direct rays of the sun and exposure times for the Front C, L and R positions. Where the sunbather schedules center (C) exposure first to be followed by left (L) and then right (R) exposure the operation may be as follows: at the end of the FC exposure time, the computer initiates a slight rotation of the chair so that the direct sun is slightly to the sunbather's left and at the end of that exposure time it initiates a slight rotation of the chair so that the direct sun is from the sunbather's right.

At the end of the Front exposures, C, L and R, the computer initiates an alarm signal to alarm 71 to alert the sunbather to turn over to expose the Back and commence exposures in the BC, BL and BR positions. After the alarm, if the sunbather does not press "continue" **65*d* on keypad 65, followed by a W signal from strain gauges 72** indicating that the sunbather has turned over or got off the chair and then got back on the chair, the computer terminates the sunbather cycle by calling for the drive to position the chair so that it faces directly away from the sun, or to a predetermined position at which the chair is shaded (position S). For example, when the sun is not directly overhead, an umbrella (not shown) attached to the chair could shade the sunbather when the chair faces away from the sun.

Computer 60 is programmed to determine the approximate elevation angle of the sun as well as the relative azimuth angle with respect to the chair. Since the CW and CCW photo-detectors 31 and 32 are facing the horizon, (oriented vertical as shown in FIG. 1) the differential between CW and CCW will remain zero when the drive tracks the sun direction while the sun moves from the horizon to directly overhead, however the magnitudes of CW and CWW will change steadily with time and that change is recorded by the computer as a measure of the change in the elevation angle of the sun. Thus, the computer determines the elevation angle of the sun after a period of operation without the time of day and the date.

As an alternative to the above technique of determining the sun elevation angle, the following operation can be implemented. If the time of day, hour (H) and minute (M) and the day (D), month (Mo) and year (Y) are also keyed into the computer, or determined by a calendar program initiated by the computer clock, the ROM or RAM program can contain such constants and the microprocessor such programs to compute the elevation angle of the sun throughout any day of the year.

With the elevation angle and the relative azimuth to the sun determined and stored in the computer, the computer can determine whether or not the chair can be rotated to a position of shade and, if so, what that position is. If there is no position of shade, audible and visible alarms can be energized to alert the sunbather at the end of the Front and Back exposure cycles.

CONCLUSIONS

Through practice of the techniques of the present invention, a sunbather can without frequently moving or changing position and while lying on a comfortable lounge expose the body to direct rays of the sun even while the sun direction changes between sunrise and sunset; and with particular features of the present invention the sunbather can select and program the time of exposure of selected sides of the body and achieve the selected exposures without frequently moving or changing position on the lounge. The specification and drawings hereof set forth the preferred embodiments of the invention and although specific terms are employed, they are used in a generic and descriptive sense only and not for purposes of limitation, the scope of the invention being defined in the following claims.

What is claimed is:

1. Apparatus for rotating a platform in the sun so that a sunbather lying on the platform is exposed to the sun, said apparatus comprising:

(a) a platform for supporting an object;

(b) means for detecting the relative direction of the sun with respect to said platform and producing sun direction signals representative of said relative sun direction, (c) a ground base, (d) means for rotatably supporting said platform from said ground base including:

(e) an axle fixed at one end and projecting substantially vertically from said fixed end thereof, (f) first and second bearings attached at spaced axial positions along said axle, (g) a bearing sleeve fixed at one end and projecting substantially vertically from said fixed end thereof in an opposite direction to said axle, (h) means for attaching said bearings to said bearing sleeve, (i) said axle and said bearing sleeve fixed ends being each fixed to a different one of said ground base or said platform, and (j) a drive motor acting between said ground base and said platform, and (k) said sun direction signal control energization of said drive motor.

2. Apparatus as in claim 1 wherein, (a) said bearings are all ball bearings, each having an inner race and an outer race, (b) said inner races are attached to said axle, and (c) said outer races are attached to said bearing sleeve.

3. Apparatus as in claim 2 wherein, (a) said fixed end of said axle provides a support for said first ball bearing inner race, (b) the opposite end of said axle provides a support for said second ball bearing inner race and (c) means are provided between said first and second ball bearing inner race supports for spacing said first and second ball bearing inner races apart, (d) whereby said first and second ball bearing inner races are firmly held by said axle spaced apart.

4. Apparatus as in claim 3 wherein, (a) said fixed end of said bearing sleeve provides a support for said second ball bearing race, (b) the opposite end of said bearing sleeve provides a support for said first ball bearing race, and (c) means are provided between said bearing sleeve outer race supports for spacing said outer races apart, (d) whereby said first and second ball bearing outer races are firmly held by said bearing sleeve spaced apart.

5. Apparatus as in claim 3 wherein, (a) said axle, bearing sleeve and bearings are contained within a closed space defined by said ground base and said platform.

6. Apparatus as in claim 5 wherein, (a) said closed space is sealed against moisture by a seal.

7. Apparatus as in claim 6 wherein, (a) said platform is located above said ground base, (b) said platform has a downwardly extending part extending toward said ground base, (c) said ground base has an outer periphery, and (d) said seal is located between said platform and said ground base periphery.

8. Apparatus as in claim 1 wherein, (a) said axle fixed end is fixed to said ground base, and (b) said bearing sleeve fixed end is fixed to said platform.

9. Apparatus for rotating an object about an axis such that the orientation of said object relative to said axis has a predetermined relationship to the location of the sun relative to said object, said apparatus comprising:

a base defining an axis;

rotation means associated with said base for supporting said object and for selectively rotating said object in a first direction about said axis in response to a first control signal and in a second direction about said axis in response to a second control signal;

control signal generating means for selectively generating said first and second control signals so as to cause said rotation means to rotate said object about said axis until the orientation of said object relative to said axis has a predetermined relationship to the location of the sun relative to said object;

said control signal generating means comprising:

first and second photodetectors each having a solar radiation receiving surface and an output signal which varies as a function of the intensity of solar radiation falling on said solar radiation receiving surface;

first and second planar elements disposed at an angle of between 0 and 180 degrees to each other such that the apex of said angle defines a line, said line being coplanar with said axis, and said first and second planar elements being coupled to said object so that said first and second planar elements rotate about said line in a predetermined relationship to the rotation of said object about said axis, and said first and said second photodetectors are attached to said first and said second planar elements respectively such that said radiation receiving surfaces of said photodetectors are disposed substantially parallel to their associated respective planar elements and face the interior of said angle; and comparator means connected between said photodetectors and said rotation means for receiving said output signals from said first and said second photodetectors and for providing said first and second control signals to said rotation means, said first control signal being adapted to cause said rotation means to rotate said object in a first direction about said axis when the output signal of said first photodetector exceeds the output signal of said second photodetector, and said second control signal being adapted to cause said rotation means to rotate said object in a second direction about said axis when said output signal of said second photodetector exceeds the output of said first photodetector.

* * * * *

UNITED STATES PATENT AND TRADEMARK OFFICE

CERTIFICATE OF CORRECTION

PATENT NO. : 5,211,172
DATED : May 18, 1993
INVENTOR(S) : Joseph B. McGuane et al.

It is certified that error appears in the above-indentified patent and that said Letters Patent is hereby corrected as shown below:

Claim 1, column 7, line 58, after the word "direction" and before the word "control", the word "signal" should be the word -- signals --.

Signed and Sealed this

Third Day of May, 1994

Bruce Lehman

*Attest:*

BRUCE LEHMAN

*Attesting Officer*

*Commissioner of Patents and Trademarks*